US006513787B1

(12) United States Patent
Jeromson et al.

(10) Patent No.: US 6,513,787 B1
(45) Date of Patent: Feb. 4, 2003

(54) TOUCHLESS FLUID SUPPLY INTERFACE AND APPARATUS

(75) Inventors: Peter James Jeromson, Howick (NZ); Jamie Jon Aorangi Wilkinson, Owairaka (NZ); Peter Stephen Barnes, Piha (NZ); Giscard Hubertus Theodoor Rutten, Beachhaven (NZ); Harold Edgar Forrest, Manurewa (NZ)

(73) Assignee: American Standard International Inc., New York, NY (US)

( * ) Notice: Subject to any disclaimer, the term of this patent is extended or adjusted under 35 U.S.C. 154(b) by 0 days.

(21) Appl. No.: 09/674,595

(22) PCT Filed: May 4, 1999

(86) PCT No.: PCT/NZ99/00054

§ 371 (c)(1),
(2), (4) Date: Jan. 4, 2001

(87) PCT Pub. No.: WO99/57381

PCT Pub. Date: Nov. 11, 1999

(30) Foreign Application Priority Data

May 4, 1998 (NZ) ..... 330352

(51) Int. Cl.[7] ..... F16K 11/00

(52) U.S. Cl. ..... 251/129.04; 137/801; 137/559; 236/12.12

(58) Field of Search ..... 236/12.12; 251/129.04; 137/801

(56) References Cited

U.S. PATENT DOCUMENTS 5,577,660 A * 11/1996 Hansen ..... 236/12.12
6,019,130 A * 2/2000 Rump ..... 137/601

* cited by examiner

*Primary Examiner*—A. Michael Chambers

(57) ABSTRACT

The fluid supply apparatus supplies and controls one or more fluids while adjusting/controlling one or more continuously parameters; and includes an outlet, at least one control valve and a touchless user control interface. For example a faucet has sensors mounted thereon to control water flow (6) and temperature (16, 17). For example a user hand in field (16) will increase temperature over time and decrease in field (17). The on/off sensor field may include the water stream, a bi-colour light emitting diode indicates temperature, temperature feedback means maintains the desired temperature, a battery or super capacitor allows operation or fluid shut off if power fails, an anti-tamper feature requires the fluid to be shut off if more than one sensor is covered and a time prevents waster wastage. The hygienic touchless interface may be in a tile or flat plate. Other applications may include panel mounted fluid control systems for controlling a plurality of fluid types and associated parameters.

24 Claims, 5 Drawing Sheets

TOUCHLESS FLUID SUPPLY INTERFACE AND APPARATUS

FIELD OF THE INVENTION

The present invention relates to a fluid supply apparatus and/or interface which provides for touchless control of the apparatus. In particular, it relates to a fluid supply apparatus and/or interface which provides for touchless control of the temperature of the fluid supplied. Further in particular, it relates to a fluid supply apparatus and/or interface which provides for touchless control of the temperature and also the on/off status of the fluid supply.

BACKGROUND TO THE INVENTION

A common application of fluid supply apparatus is with wash basins. Many wash basins include a single faucet spout through which water is supplied at a desired temperature. The water is turned on and off and the temperature of the water varied, typically, by way of one or more valves with one or more handles, spindles or levers. One disadvantage with these types of wash basin water supplies is that the user must make physical contact with the handle, spindle or lever. In applications where a high level of sterilisation or hygiene is required, this contact may be disadvantageous as the handles may not be sterile. This type of arrangement may also be disadvantageous where the user has a physical impairment which makes manipulation of the handle, spindle, or lever difficult.

One attempt at overcoming some of the problems associated with conventional faucet arrangements is to have large levers which may be manipulated by the elbows of a user. However, this still requires some contact between the user and the levers.

Another attempt at overcoming the above-mentioned disadvantages is to provide controls for the fluid supply that are manipulated by a foot of the user. Typically, these only allow for on/off control of the fluid. Also, the feet of users may be less adept at manipulating controls than the hands of users.

Another disadvantage of conventional faucet arrangements is that the water supply may be left running after the user has left. This may result in water being wasted. One attempt to overcome this is to have faucet controls which are depressed to allow water to be supplied and which slowly return to a non-depressed position to cut the water supply after a given interval. Typically, these require contact between the user and the faucet controls.

Such difficulties are also encountered in situations where the fluid outlet is located remotely or is distant from the controlling means. For example, the outlet may be close to the floor, above the users head (as in a shower) or located quite some distance from the users control location. In situations such as these, it may still be important for a user to be able to control the fluid flow within the hygene or other constraints discussed above.

One attempt at overcoming some of the above disadvantages is a "variable temperature electronic water supply system" which is disclosed in the United States Patent Specification numbered U.S. Pat. No. 5,504,950. This water supply system includes a touchless infrared sensor which detects the presence of hands purely for the purpose of switching the water supply on or off. The water supply system also includes a touch pad interface on top of a water spout to allow the user to vary temperature. Temperature may only be varied by choosing one of a number of predetermined ratios of hot and cold water.

The water supply system disclosed in U.S. Pat. No. 5,504,950 suffers the following limitations. Firstly, the user cannot vary temperature without making physical contact with the spout. This contact may be unhygienic or not sufficiently sterile for some purposes. Secondly, the temperature may only be varied between coarse predetermined settings. Fine adjustment of the temperature by the user is not provided for. Also, the predetermined temperature settings correspond to predetermined mixing of hot and cold water supplies, the temperatures and pressures of which may be adjusted to regulate the temperature at the coarse settings. Adjustment of the temperature itself and the regulation of temperature at any given setting is not provided for. Thirdly, the particular system of arranging for mixing of the hot and cold water supplies may be relatively cumbersome, particularly with regard to the quantity of materials needed.

Accordingly, it is an object of the present invention to provide a fluid supply system which allows for touchless variation of the temperature of the fluid supplied, or at least to provide the public with a useful choice.

DISCLOSURE OF THE INVENTION

According to one aspect of the present invention, there is provided a fluid supply apparatus suitable for supplying fluid, the fluid supply apparatus including:

- at least one fluid outlet assembly from which the fluid may emerge;
- at least one fluid control valve which allows variable control of the temperature of the fluid supply;
- at least one touchless control user interface adapted to receive touchless control instructions from a user, wherein the Touchless control instructions may very the temperature of the fluid supply;
- at least three touchless sensors mounted on said fluid outlet assembly, each said sensor adapted to sense an object in a respective sensing field;
- wherein at least one of said touchless sensors enables the switching on and off of the fluid supply;
- wherein at least one other of said touchless sensors enables the temperature of said fluid supply to increase;
- wherein at the temperature of said fluid supply to decrease.

In an alternative aspect, the present invention provides for a stand-alone fluid control interface adapted to receive touchless control instructions from a user.

Preferably the stand-alone fluid control interface is mounted in a wall plate, tile or the like.

Preferably the stand-alone fluid control interface is constructed in the form of a tile, the tile may be shaped and dimensioned so as to be capable of mounting in a wall mounted location.

Preferably, the touchless control instructions may also turn the fluid supply on or off.

Preferably, the touchless control user interface includes a plurality of touchless sensors each adapted to sense an object in a respective sensing field.

Preferably, at least one of the sensors is adapted to transmit light and sense light reflected off an object positioned within a respective sensing field.

Preferably, at least one of the sensors is disposed in the fluid output assembly.

Optionally, at least one of the sensors is disposed at a location on the faucet, the location selected so that it is easily accessible to a users hands when using the faucet, preferably, the sensors being located proximate a base of the faucet.

Alternatively, at least one of the sensors may be located remote from the fluid output assembly.

Preferably, the touchless sensor user interface includes at least three sensors disposed in the fluid output assembly.

Alternatively, the at least three sensors may be located remote from the fluid output assembly.

Preferably the touchless control user interface includes at least one sensor disposed such that the sensing field of that at least one sensor substantially contains a portion of a trajectory of fluid emerging from the fluid spout assembly.

Preferably, the touchless control, user interface includes sensors disposed to have sensing fields to either side of the fluid output assembly.

Preferably, the sensors are disposed near an end of the fluid output assembly.

Preferably, the fluid supply apparatus is arranged such that the supply of fluid is switched on when an object is placed near the outlet of the fluid supply means and substantially in the trajectory of fluid that emerges from the fluid supply means and, preferably, the supply of fluid is switched off otherwise.

Preferably the touchless control user interface is arranged such that the temperature of the fluid may be increased by placing an object to one side of the end of the fluid output assembly and the temperature may be decreased by placing an object to another side of the end of the fluid output assembly.

Preferably, the touchless control, user interface includes a first controller which monitors the sensors and determines an on/off status and also a desired fluid temperature.

Preferably, the first controller is disposed in the fluid output assembly.

Preferably, the fluid supply apparatus includes a second controller which controls the fluid control valve according to information relating to the desired temperature and/or the on/off status.

Preferably, the fluid supply apparatus is adapted to use temperature feedback to maintain the fluid temperature substantially at the desired temperature.

Preferably, the fluid supply system includes a timer which provides a delay for the cessation of the fluid supply after the removal of any object from the sensing path of any of the sensors.

Preferably, the fluid supply apparatus is arranged such that no fluid is supplied if one or more of the sensors is covered so as to render it inoperable.

Preferably, the fluid supply apparatus includes a battery backup.

Preferably, the fluid supply apparatus includes a user display including at least two light sources in at least two different colours, wherein the brightness of each diode, as perceived by the human eye, may be varied individually to provide a range of colours, as perceived by the human eye, to represent different temperatures of the fluid.

According to another aspect of the present invention, there is provided a fluid supply apparatus for supplying fluid with at least one given parameter which is variable, the fluid supply apparatus including:

at least one control, user interface adapted to receive controlling instructions from a user;

at least one fluid control valve which allows variable control of the or each given parameter, wherein the control, user interface determines a desired value of the or each given parameter and an on/off status for the supply of fluid and the or each fluid control valve receives a signal from the control, user interface, the signal containing information on the desired value of the or each given parameter and the on/off status and provides a fluid supply at the desired value of the or each given parameter in conjunction with an on status.

According to another aspect of the present invention, there is provided a basin and faucet arrangement, including a fluid supply apparatus as described in any one of the preceding paragraphs.

According to another aspect of the invention, there is provided a shower and/or bath arrangement, include a fluid supply apparatus as described in any one of the preceding paragraphs.

Preferably, in the case of the shower and/or bath arrangement, the touchless control assembly is mounted in a wall plate, tile or the like.

According to another aspect of the present invention, there is provided a fluid supply apparatus substantially as herein described with reference to the accompanying drawings.

BRIEF DESCRIPTION OF THE DRAWINGS

The present invention will now be described by way of example only and with reference to the drawings in which.

DETAILED DESCRIPTION OF THE DRAWINGS

Figure 1:
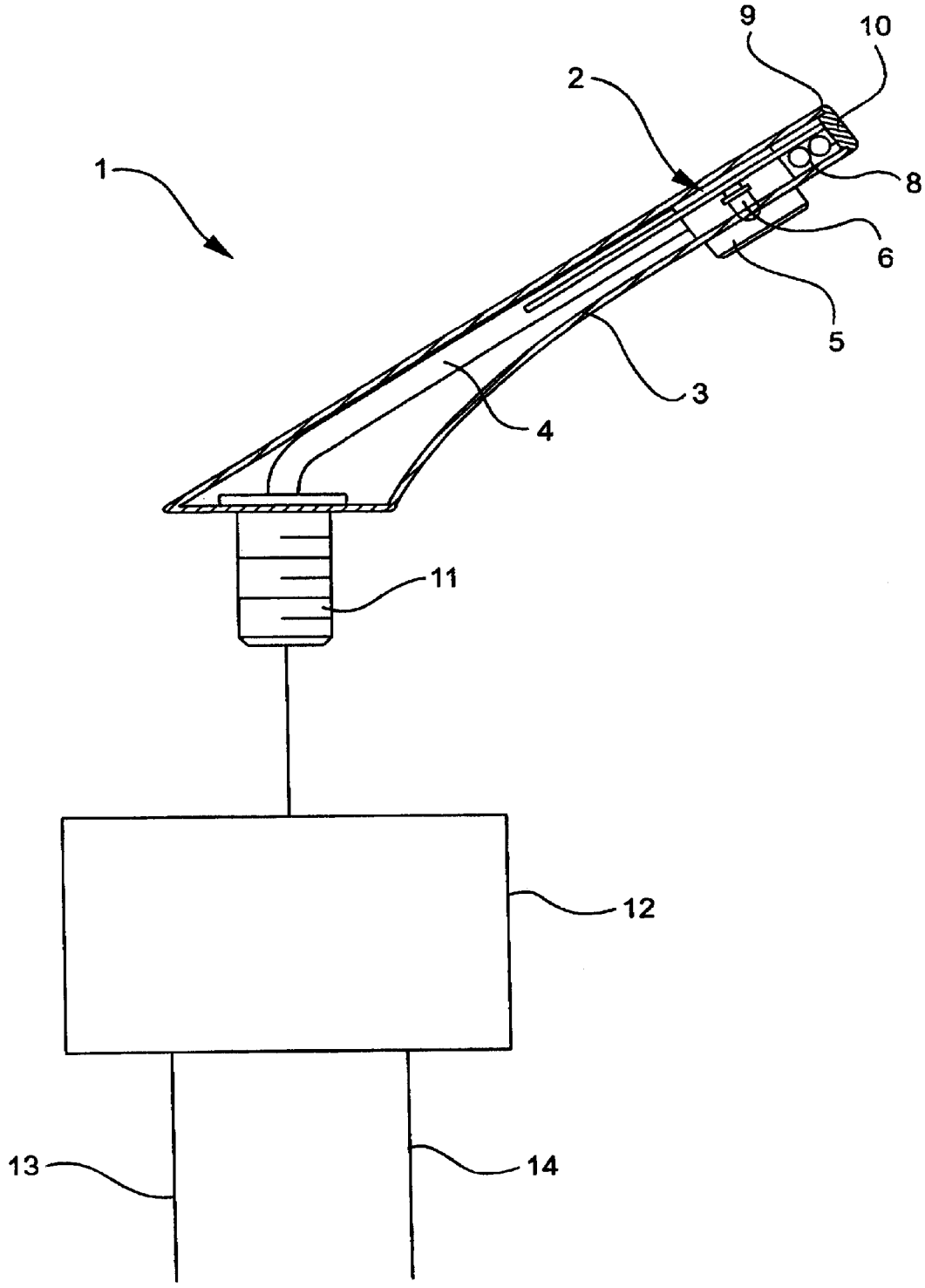
FIG. 1: shows a cut-away side elevation of a spout assembly of a fluid supply apparatus in accordance with the present invention.

A preferred embodiment of the fluid supply apparatus 1 is schematically shown in FIG. 1. The fluid supply apparatus 1 includes a Spout, or outlet, assembly 2 having a spout housing 3, fluid duct 4 and fluid outlet member 5. The fluid supply apparatus 1 also includes on/off touchless sensors 6 and two sets of temperature control touchless sensors 7 and 8 and a sensor control circuit board 9. A wide range of suitable touchless sensors will be apparent to those skilled in the art and any of these may be used with this invention A preferred embodiment of this invention uses infrared sensors which include a diode to transmit infrared light and a corresponding diode to receive light which is being transmitted and reflected off an object. A wide range of suitable circuitry and placement and housing of the circuitry will be apparent to those skilled in the art and these may also be applied to this invention.

Figure 6:
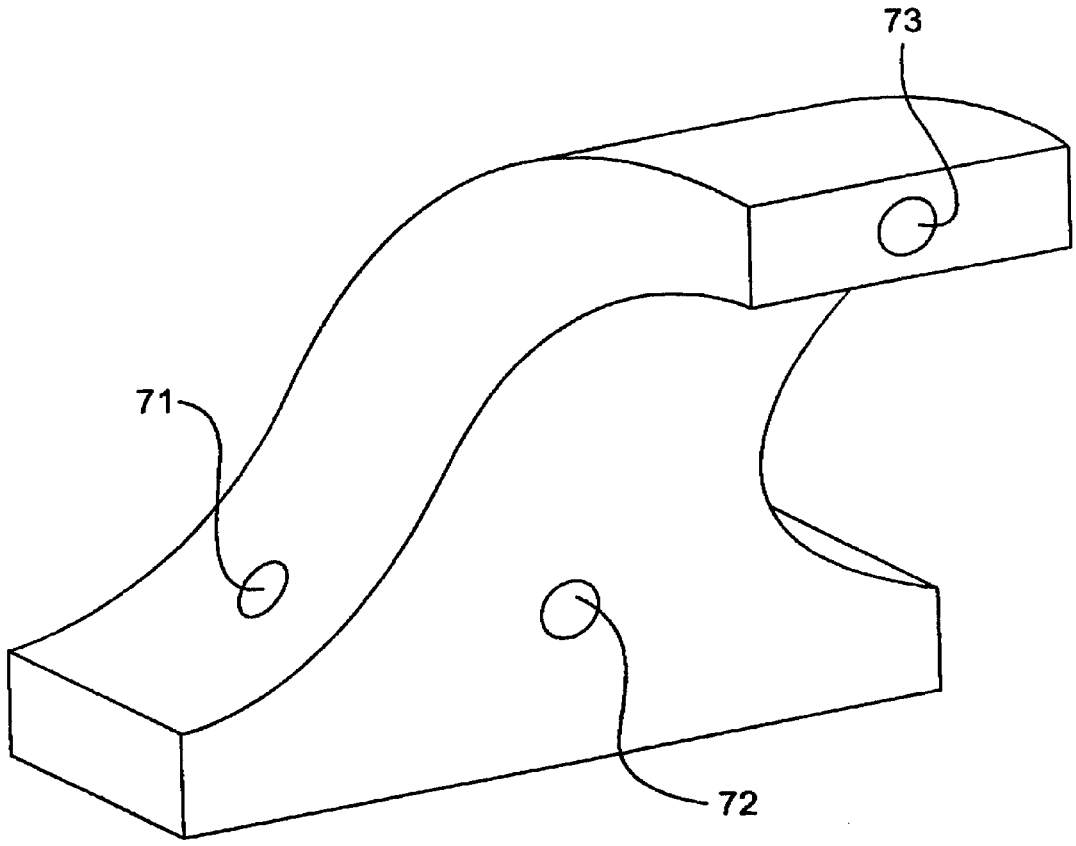
FIG. 6: illustrates a faucet with sensors located in alternative positions.

A preferred embodiment of the present invention includes a U-shaped circuit board 9, which is fitted into the end of the spout housing 3. In the preferred embodiment, the sensors are mounted directly onto the circuit board 9 The spout housing 3 may be provided with a removable cap 10 to allow insertion and removal of the circuit board 9. An alternative arrangement of sensors 18 shown in FIG. 6 whereby sensors 71, 72 and 73 are located at positions on the faucet body which are selected to be particularly accessible to a users hands when the faucet. Here sensor 71 is one of the temperature adjusting sensors, 72 the on/off sensor and 73 the bi-color light emitting diode which emits light ranging from the blue (cold) to red (hot).

The fluid supply apparatus may also include a mounting member 11 to facilitate the mounting of the spout to a wash basin, wall or similar. Any suitable mounting member 11 known to those skilled in the art may be applied to this invention.

A thermostatic valve 12 supplies fluid to the spout assembly 2 and, in turn, is supplied with, preferably, two fluids of differing temperature. It is to be appreciated that temperature is merely an example of a parameter which may be associated with supply fluids. A wide range of alternative parameters will be apparent to those skilled in the art, and may, for example, include pH level, viscosity, or concentration of a given chemical reagent.

A preferred embodiment of this invention requires that the thermostatic valve is able to switch the supply of fluid on or off and also vary the temperature, for example, by varying the ratio of the hot and cold fluid supplies, 13 and 14 respectively.

Preferably, the thermostatic valve includes temperature feedback to facilitate maintenance of a given temperature in the event of fluctuations in the temperature or pressure of the fluid supplies 13 and 14.

A suitable thermostatic valve for use in this invention is disclosed in the patent specification accompanying PCT Patent Application PCT/NZ97/00168. The disclosure of this specification is herein incorporated in the present specification.

Figure 2:
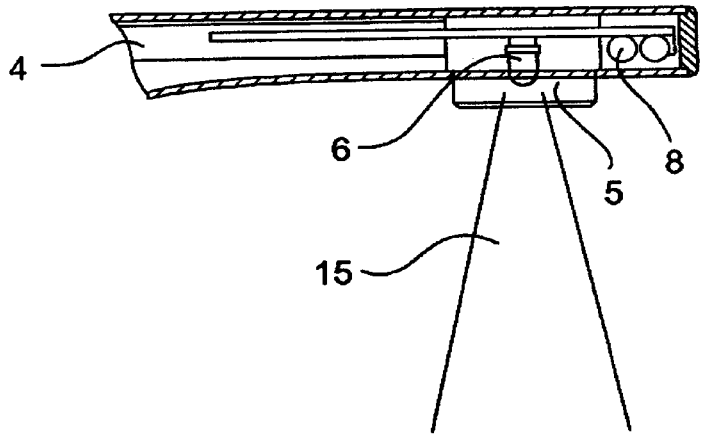
FIG. 2: shows a side view of a spout assembly associated with a fluid supply apparatus in accordance with the present invention showing the on/off sensing field.
Figure 3:
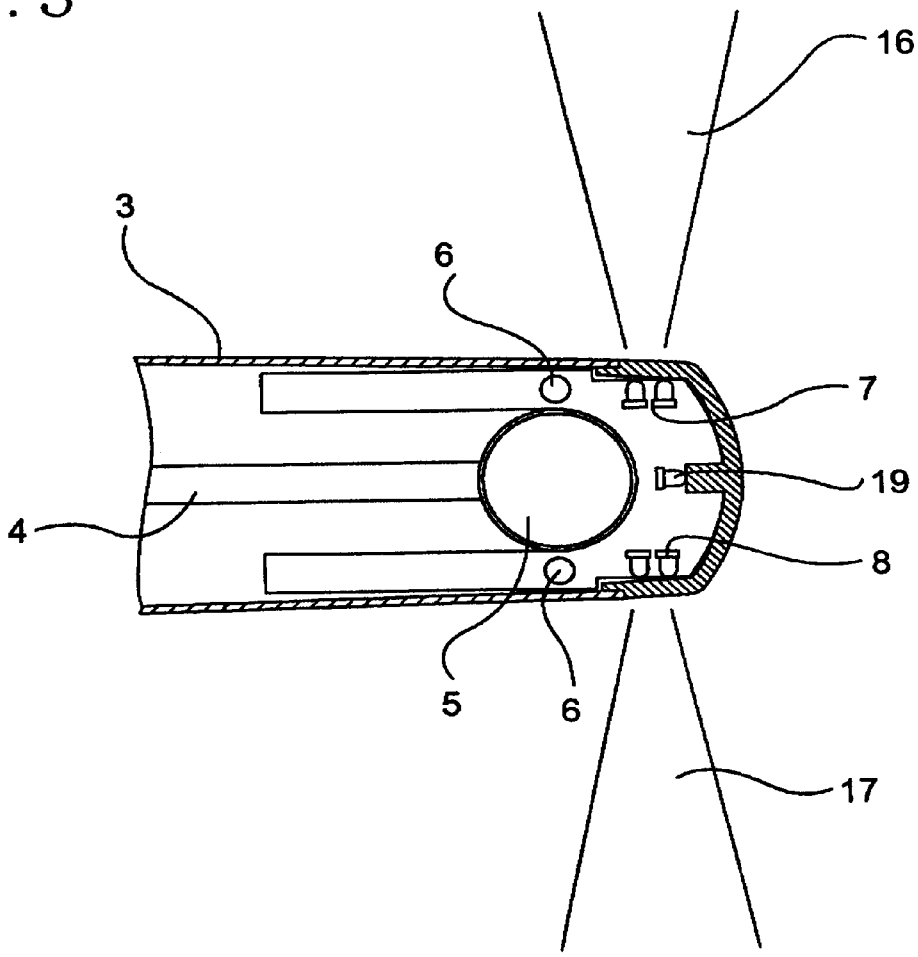
FIG. 3: shows a top view of a spout assembly in accordance with the present invention showing the temperature control sensing fields.

Close-up views of the spout assembly 3 are shown in FIGS. 2 and 3. These figures show typical sensing fields of the sensors which collectively form part of a touchless control user interface. An alternative embodiment of a touchless control interface in the form of a stand-alone interface untit will be described in detail below. The on/off sensing field 15 may, typically, be arranged to include a region underneath the fluid outlet 5 in which the user may place their hands for washing. Preferably, this region would encompass part of the trajectory of supplied fluid emerging from the fluid outlet 5. Field 16 may, typically, be arranged to include a region to one side of the end of the spout assembly 3, and field 17 a region to the right of the spout housing 3.

A user of a preferred embodiment of the fluid supply apparatus may place their hands under the fluid outlet 5, and, therefore, in the on/off sensing field 15, to switch on the fluid supply. By placing a hand in field 16, for example, the user may cause the temperature to increase over time. The temperature may be decreased over time by placing a hand in the other field 17, for example. Therefore, the user may give instructions for on/off and temperature control of the fluid supply apparatus by placing their hand(s) in the sensing fields for given durations.

A cut-away top view of the end of the fluid supply assembly 2 is shown in FIG. 3. The sensor circuit board 9 complete with sensors 7 and 8 is formed in a U-shape so that it may fit around the fluid supply outlet 5. Of course other shapes of circuit board may be suitable for different faucet assemblies. This allows the sensors 7 and 8 to be positioned near the end of the fluid supply housing 3 while being attached to the sensor circuit board 9.

Figure 4:
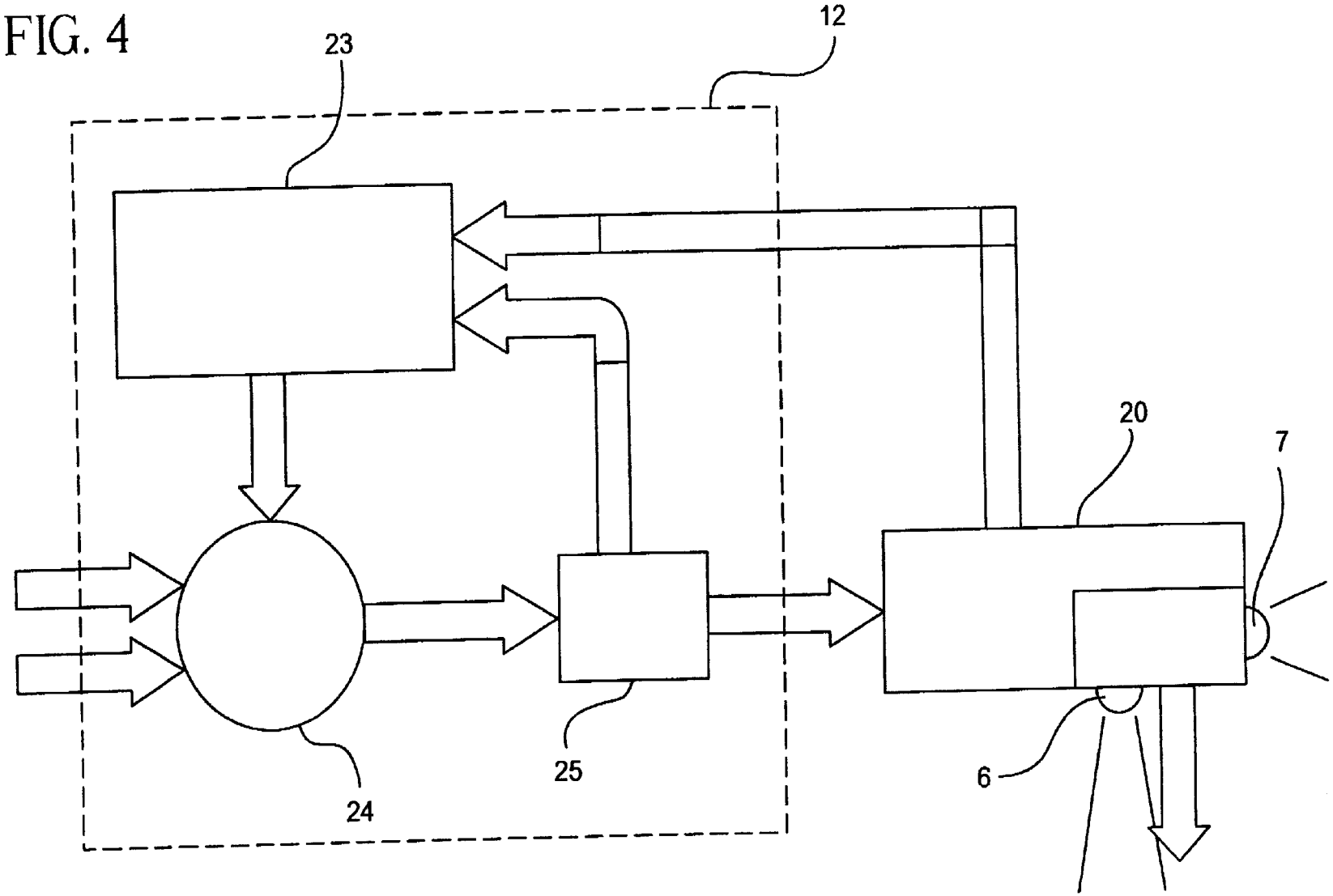
FIG. 4: schematically shows the operation of the fluid supply apparatus.

The operation of a preferred embodiment of the fluid supply apparatus is schematically shown in FIG. 4. The sensor interface circuit 20 receives signals from the on/off sensor 6 and the temperature variation sensors 7 and 8. From the on/off sensor 6, the sensor interface circuit determines an on/off status and a corresponding on/off status signal code to represent that status.

From the sensors 7 or 8, the sensor controller circuit 20 determines whether objects are in the respective sensing fields 16 and 17 and for how long and determines a desired temperature and a corresponding temperature status signal code.

The signal codes corresponding to on/off status and desired temperature status signal code are communicated to the thermostatic valve controller circuit 23. The thermostatic valve controller circuit controls the servo mixing valve 24 to be on or off and to output fluid at the desired temperature communicated to the thermostatic valve controller by way of the desired temperature status signal code. The temperature of the fluid at the output of the servo mixing valve 24 is monitored by the thermostatic valve controller 25 by way of a temperature sensor 25 in the fluid flow. This temperature feedback allows the thermostatic valve controller to adjust the servo mixing valve 24 so that the temperature of fluid at the output of the thermostatic valve is maintained at the desired temperature as communicated to the thermostatic valve controller by way of the desired temperature status signal code.

It will be apparent to those skilled in the art that according to the preferred embodiment, the thermostatic valve 12 merely receives signal codes to determine the on off status and temperature desired and that it then outputs fluid, when required, at the desired temperature. The sensor interface circuit 20, in association sensors 6, 7 and 8, acts to determine a desired temperature and on/off status and communicates it to the thermostatic valve 12. Therefore, it will be clear that a number of different types of sensor interface circuit 20, perhaps corresponding to different types of sensors, may be used with the same type of thermostatic valve 12. If, for example, inductive or capacitive sensors, or even buttons are to be used, a suitable sensor interface circuit can be used with the same thermostatic valve 12.

It will be apparent to those skilled in the art that if desired, the thermostatic valve controller 23 and sensor interface circuit 20 may be incorporated into one single controller if desired.

The preferred embodiment preferably includes a power back up such as a battery, super capacitor, or the like, so that the fluid supply may be closed in the event of a power cut. Although, the power back up may allow normal operation for a while before the fluid is shut off.

The preferred embodiment may default to the fluid supply being switched off to avoid of fluid being wasted. It may also be set to switch the fluid supply off after a given time interval provided by a timer which is, preferably, included in the sensor interface sensor 20.

Additionally, the fluid supply apparatus 1 may include an anti-tamper feature which provides that the fluid supply is switched off in the event that one or more of the sensors 6, 7, or 8 are covered. In this case, the fluid supply may be ceased until the sensors are uncovered.

The preferred embodiment of the fluid supply apparatus 1 includes a display to give temperature related feedback to the user. This is preferably in the form of coloured light emitting diodes LEDs, for example red and blue. The LEDs can be used to give a range of colours such as red, blue and shades of purple to represent temperature such as hot, cold and various intermediate temperatures. The colours may be varied by varying the intensity of light from each of the LEDs. This is typically done by supplying a pulse width modulated current to each of the LEDs. Typically, the current to one LED is off when the current to the other is on. For example, if purple light which is predominantly blue is required, an on current which switches off for a brief period at a given frequency is provided for the blue LED. During these off times, a brief current pulse is provided for the red LED. Provided the frequency of the on or off pulses is high enough, the human eye will not detect any flicker. Both LEDs may be incorporated into one unit 19.

The present invention allows convenient and touch free operation of a fluid supply system, such as a mixing faucet. This touchless control allows a high level of hygiene for use of the apparatus.

The preferred embodiment of the present invention allows convenient manufacture of fluid supply apparatus for a range of different applications. Although the fluid outlet is, in the preferred embodiment, combined into a single unit with the interface, in an alternative embodiment the fluid outlet part may not be physically part of the control interface. Convenient manufacturing of the combined units is facilitated by the valve control operation being separated from the sensor control operations. A separate controller is used to operate the sensors and determine a required temperature and on/off status, whereas the thermostatic valve includes another controller which receives that information and controls the valve to provide fluid at the desired temperature when required. This thermostatic valve may be used in conjunction with a range of different types of sensor controllers adapted for different types of sensors.

Figure 5:
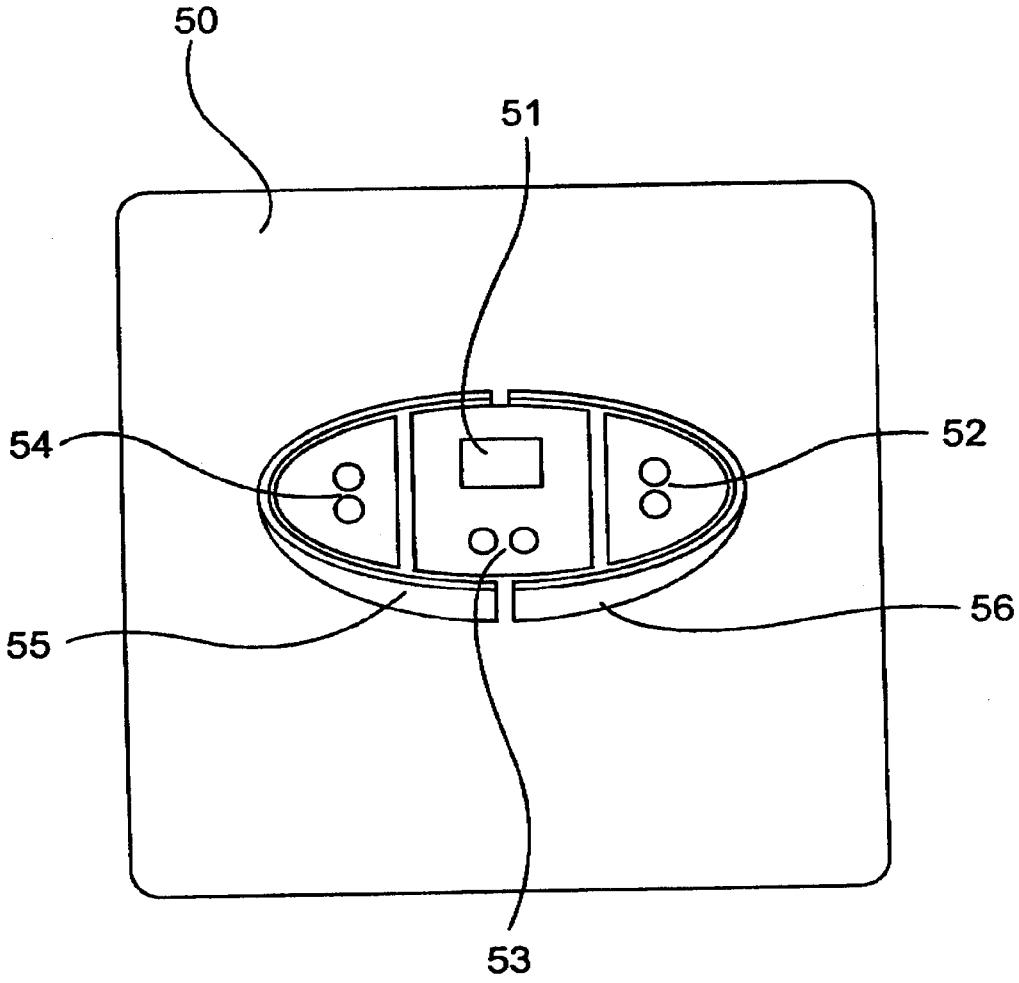
FIG. 5: illustrates an embodiment of a stand-alone touchless fluid control interface.

An alternative embodiment is shown in FIG. 5. Referring to FIG. 5, a stand-alone fluid control interface is shown. In this embodiment, the fluid outlet is not physically connected to the interface. Here, the fluid control interface is adapted to be mounted in a wall plate, tile or the like. Of course the interface may be shaped to fit the desired mounting location. Such a location could even include a bath lip, corner fitting or wall mount.

An application for this embodiment may be where the actual fluid outlet is to be positioned remotely or distantly from the users control interface. Such a situation might be in a shower and/or bath where it is desirable that the control interface be located on the wall of the shower enclosure, while the outlet is located above the user.

The stand-alone interface described in this embodiment may have substantially the same functionality (apart from incorporating the fluid outlet)as the integrated unit described in the context of the faucet. Referring to FIG. 5, a wall plate or tile 50 has located thereon sensors 52, 54 and 53. Indicia 55 and 56 are coloured blue and red respectively and indicate the effect of activating the corresponding sensors will be. For example, adjusting the water temperature by way of interacting with the sensors 54 on the left of the interface increases or decreases the cold water flow—the indicia 55 being coloured blue appropriately.

The stand-alone interface may include a temperature readout 51. This is preferably digital. However, other iconic or indicator-like readouts may be used. Sensors 53 switch the fluid flow off and on and sensors 54 and 52 operate as described elsewhere in this specification.

It is envisaged that the stand-alone embodiment provides particular utility in situations where a wall-mounted controller is required. Such a control interface is not necessarily tied to, or built into the actual fluid outlet as is illustrated in FIGS. 1 to 4. Although the prime application of this embodiment is in shower and/or bath situations, it is envisaged that this embodiment may be used in remote fluid control. For example, in control panel arrays in process control applications where a number of different fluids and fluid characteristics may be adjusted/monitored.

The preferred embodiment of the present invention also provides a simple display to provide feedback on the temperature of fluid that is or is about to be supplied by the fluid supply apparatus.

The preferred embodiment of the present invention also allows precise, touchless user control of water temperature, or any other variable parameter of a given fluid, and allows the temperature to be maintained irrespective of fluctuations in the pressure or temperature of the water supply to the thermostatic valve, due to the inclusion of temperature feedback.

The preferred embodiment of the present invention conveniently allows for predetermined operation of the fluid supply apparatus, such as anti-tamper timers and such like.

Where in the foregoing description, reference has been made to specific components or integers of the invention having known equivalents, then such equivalents are herein incorporated as if individually set forth.

Although this invention has been described by way of example and with reference to possible embodiments thereof, it is to be understood that modifications or improvements may be made thereto without departing from the scope of the invention.

What is claimed is:

1. A touchless, temperature control faucet including:

at least one fluid outlet assembly from which the fluid emerges;

at least one fluid control valve which allows variable control of the temperature of the emerging fluid based on temperature feedback by a temperature signal from a temperature sensor arranged downstream of the fluid control valve;

at least one touchless control user interface adapted to receive touchless control instructions from a user, wherein the touchless control instructions varies the temperature of the emerging fluid;

at least three touchless sensors mounted on said fluid outlet assembly, each said sensor adapted to sense an object in a respective sensing field;

wherein at least one of said touchless sensors enables the switching on and off of the emerging fluid;

wherein at least one other of said touchless sensors enables the temperature of said emerging fluid to increase;

wherein at least one other of said touchless sensors enables the temperature of said emerging fluid to decrease.

2. The faucet as claimed in claim 1 wherein said touchless control user interface and said touchless sensors operate independently of the distance of the object in a respective sensing field.

3. The faucet as claimed in claim 1 wherein said at least one fluid control valve comprises a thermostatic valve.

4. The faucet as claimed in claim 1 which includes at least two fluid inlets and wherein the at least one fluid control valve is a temperature control valve which mixes varying ratios of fluids from said at least two fluid inlets.

5. The faucet as claimed in claim 1 which includes a user display including at least two visual indicators for showing a direction of fluid temperature adjustment.

6. The faucet as claimed in claim 5 wherein the first controller is disposed in the fluid outlet assembly.

7. The faucet as claimed in claim 1 which includes a second controller which controls the fluid control valve according to information relating to the desired temperature and/or the on/off status.

8. The faucet as claimed in claim 1 wherein at least one of the sensors is adapted to transmit light and sense light reflected off an object positioned within a respective sensing field.

9. The faucet as claimed in claim 1 wherein the touchless control user interface includes at least one sensor disposed such that the sensing field of that at least one sensor substantially contains a portion of a trajectory of fluid emerging from the fluid outlet assembly.

10. The faucet as claimed in claim 1 wherein the touchless control user interface includes sensors disposed to have sensing fields to either side of the fluid outlet assembly.

11. The faucet as claimed in claim 1 wherein the sensors are disposed near an end of the fluid outlet assembly.

12. The faucet as claimed in claim 1 wherein the fluid outlet assembly includes a faucet, wherein at least one of the sensors is disposed at a location on the faucet, the location selected so that it is accessible to a user's hands when the user uses the faucet the at least one sensor being located proximate a base of the faucet.

13. The faucet as claimed in claim 1 wherein the fluid supply apparatus is arranged such that the supply of fluid is switched on when an object is placed near the outlet of the faucet, substantially in the trajectory of fluid that emerges from the fluid supply means, and the supply of fluid is switched off otherwise.

14. The faucet as claimed in claim 1 wherein the touchless control user interface is adapted so that the temperature of the fluid may be increased by placing an object to one side of the end of the faucet and the temperature may be decreased by placing an object to another side of the faucet.

15. The faucet as claimed in claim 7 wherein the touchless control user interface includes a first controller which monitors the sensors and determines an on/off status and also a desired fluid temperature.

16. The faucet as claimed in claim 1 which uses the temperature feedback to maintain the fluid temperature substantially at the desired temperature.

17. The faucet as claimed in claim 1 which includes a timer which provides a delay for the cessation of the fluid supply after the removal of any object from the sensing path of any of the sensors.

18. The faucet as claimed in claim 1 which arranged such that no fluid is supplied if one or more of the sensors is covered so as to render it inoperable.

19. The faucet as claimed in claim 1 which includes a battery backup.

20. The faucet as claimed in claim 1 which includes a user display including at least two visual indicators in at least two different colors, wherein the brightness of each indicator, as perceived by the human eye, may be varied individually to provide a range of colors, as perceived by the human eye, to represent different temperatures of the fluid.

21. The faucet as claimed in claim 20 wherein said visual indicators are light source indicators.

22. The faucet as claimed in claim 21 wherein said light source indicators are LEDs.

23. The faucet as claimed in claim 1 including hot and cold temperature control sensors disposed to either side of a substantially central on/off sensor area.

24. The faucet as claimed in claim 1 wherein the sensors are adapted so that the supply of fluid is switched on when an object is temporarily placed near the substantial central on/off sensor area and the supply of fluid is subsequently switched off when an object is placed near the on/off sensor area.

* * * * *